US006483049B1

(12) United States Patent
Mohtasham

(10) Patent No.: US 6,483,049 B1
(45) Date of Patent: Nov. 19, 2002

(54) CONTACT ASSEMBLY

(75) Inventor: Mehdi Mohtasham, Astley (GB)

(73) Assignee: EJA Engineering Limited, Wigan (GB)

( * ) Notice: Subject to any disclaimer, the term of this patent is extended or adjusted under 35 U.S.C. 154(b) by 0 days.

(21) Appl. No.: 09/675,865

(22) Filed: Sep. 29, 2000

(51) Int. Cl.[7] ..... H01H 9/00
(52) U.S. Cl. ..... 200/5 R; 200/243
(58) Field of Search ..... 200/243, 284, 200/164, 237–251, 550, 500, 535, 447, 448

(56) References Cited

U.S. PATENT DOCUMENTS 3,691,331 A * 9/1972 Resh ..... 200/67 DB
4,064,381 A * 12/1977 Mullen et al. ..... 200/16 A
4,277,662 A * 7/1981 Lewandowski ..... 200/242
4,443,675 A * 4/1984 Drexler et al. ..... 200/243
4,839,475 A * 6/1989 Wilkinson et al. ..... 200/5 R
5,347,250 A * 9/1994 Muske ..... 335/132

* cited by examiner

*Primary Examiner*—Lincoln Donovan
*Assistant Examiner*—Lisa Klaus
(74) *Attorney, Agent, or Firm*—Michael A. Jaskolski; Alexander M. Gerasimow; William R. Walbrun

(57) ABSTRACT

A contact assembly comprising a plurality of pairs of spaced apart fixed contacts supported in an electrically insulating body, an actuator displaceable relative to the body between first and second positions, and a plurality of movable contacts mounted on the actuator. Each movable contact is positioned on the actuator so as to interconnect the contacts of one of the pairs of fixed contacts only when the actuator is in one of the first and second positions. Each fixed contact has two limbs defining an L-shape, one limb defining a single leg which extends through an aperture formed in a partition defined by the body and the other limb extending to one side of the leg to define a head supporting a terminal for gripping a wire. Each movable contact is displaceable into contact with the leg of each of the respective pairs of fixed contacts on the side of the leg from which the head extends and on the side of the partition remote from the head.

18 Claims, 4 Drawing Sheets

CONTACT ASSEMBLY

TECHNICAL FIELD

The present invention relates to a contact assembly and in particular to a contact assembly in which pairs of spaced apart fixed contacts are supports in an electrically insulating body and sets of movable contacts are displaceable relative to the insulating body so as to either interconnect or disconnect the contacts of each of the pairs of fixed contacts.

BACKGROUND ART

In one known contact assembly, three pairs of spaced apart fixed contacts are supported in an electrically insulating body. An actuator is displaceable relative to the body and carries three movable contacts. Each of the three movable contacts is associated with one of the pairs of fixed contacts. The actuator is displaceable between two positions. For each of the movable contacts, when the actuator is in one of the two positions the movable contact bears against the associated pair of fixed contacts so as to electrically interconnect them whereas when in the other of the two positions the movable contacts is spaced from the associated pair of fixed contacts so as to electrically separate the fixed contacts. Thus the movable and fixed contacts define three switches which are opened and closed by displacing the actuator relative to the insulating body. It may be that when the actuator is in a first position a first switch is closed (that is to say the fixed contacts of that switch are electrically interconnected by the associated movable contact), the second switch is closed and the third switch is open, whereas when the actuator is in the second position the first and second switches are open and third switch is closed.

In the known contact assembly, each of the fixed contacts is defined by a U-shaped body having a central section supporting a cable clamp and two legs extending from opposite ends of the central section. The legs extend through apertures in the insulating body into a compartment within which the associated movable contact is received between the legs. Given that the movable contact must be displaceable between the two legs from a first position in which the movable contact makes electrical contact with one of the legs and a second position in which the movable contact is electrically isolated from both of the legs the spacing between the legs must be sufficient to accommodate displacement of the movable contacts and to maintain an acceptable separation between the movable and fixed contact when the switch formed by those contacts is open. The spacing between adjacent fixed contacts of different switches must also be sufficient to maintain electrical separation. This sets a limit on the minimum size of the overall assembly and in particular the number of pairs of fixed contacts which can be accommodated within a predetermined volume.

In the known contact assembly, that portion of each fixed contact against which the associated movable contact bears when the switch is closed is provided with a surface treatment (for example of silver) to improve resistance to wear. If a movable contact is displaced against a portion of the surface of a fixed contact which does not have the appropriate surface treatment rapid wear and hence contact failure results. Given that only one of the two legs of the U-shape fixed contact is given the appropriate surface treatment, it can happen that the fixed contacts are inserted with the leg positions reversed as compared with that which was intended. Considerable care must therefore be taken to ensure that the fixed contacts are inserted in the correct orientation and this adds to manufacturing complexity and cost.

DISCLOSURE OF INVENTION

It is an object of the present invention to obviate or mitigate the problems outlined above.

According to the present invention there is provided a contact assembly comprising a plurality of pairs of spaced-apart fixed contacts supported in an electrically insulating body, an actuator displaceable relative to the body between first and second positions, and a plurality of movable contacts mounted on the actuator, each movable contact being positioned on the actuator so as to interconnect the contacts of a respective pair of fixed contacts only when the actuator is in one of the first and second positions, wherein each fixed contact has two limbs defining an L-shape, one limb defining a single leg which extends through an aperture formed in a partition defined by the body and the other limb extending to one side of the leg to define a head supporting a terminal for gripping a wire, and wherein each movable contact is displaceable into contact with the leg of each of the respective pairs of fixed contacts on the side of the leg from which the head extends and on the side of the partition remote from the head.

In contrast with contact assemblies in which the fixed contacts are U-shaped, the L-shaped contacts in accordance with the present invention make it possible to accommodate more pairs of fixed contacts in a given volume. It also makes it possible to design the insulating body so that contacts can only be inserted in the correct orientation or, if the position of individual fixed contacts is reversible, makes it possible to readily visually detect the orientation in which a fixed contact has been inserted. Thus not only can the number of contacts within a given volume be increased but in addition the assembly process is simplified.

Preferably, the leg of each fixed contact defines at least one projection which engages behind an edge of the aperture in the partition through which it is inserted so as to retain the fixed contact in position relative to the insulating body. Each fixed contact may be formed from a single strip of metal bent so that the leg extends at substantially 90° to the head. The terminal for gripping a wire may be a simple screw received in a thread formed in the head of the fixed contact.

The insulating body may be a snap fit within a casing, the insulating body defining a recess and the actuator being received within the recess so as to be retained between the insulating body and the casing. The actuator may comprise a carrier displaceable relative to the insulating body with the movable contacts being supported by and displaceable relative to the carrier. Each movable contact may be spring biased relative to the carrier to a rest position in which it bears against the carrier and from which it is displaced to a working position when bearing against the fixed contacts. Each movable contact when in the rest position may be inclined to its orientation when in the working position. The actuator may be spring biased relative to the insulating body and the insulating body may carry a label extending over the fixed contact and indicating the normal status of the switches defined by the associated movable and fixed contacts.

BRIEF DESCRIPTION OF DRAWINGS

An embodiment of the present invention will now be described, by way of example, with reference to the accompanying drawings, in which.

BEST MODES FOR CARRYING OUT THE INVENTION

Figure 1:
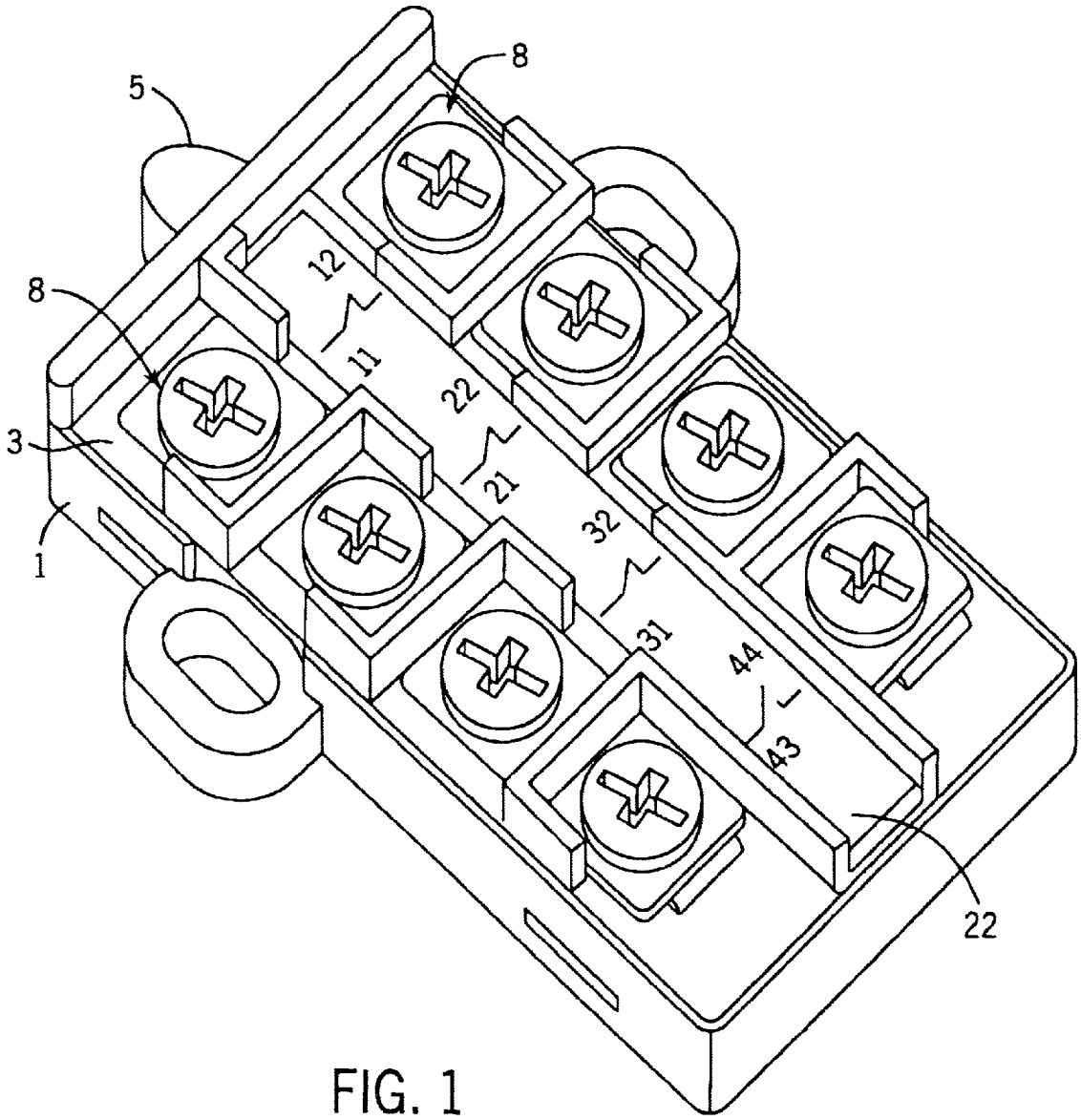
FIG. 1 is a view from above of a contact assembly in accordance with the present invention.
Figure 2:
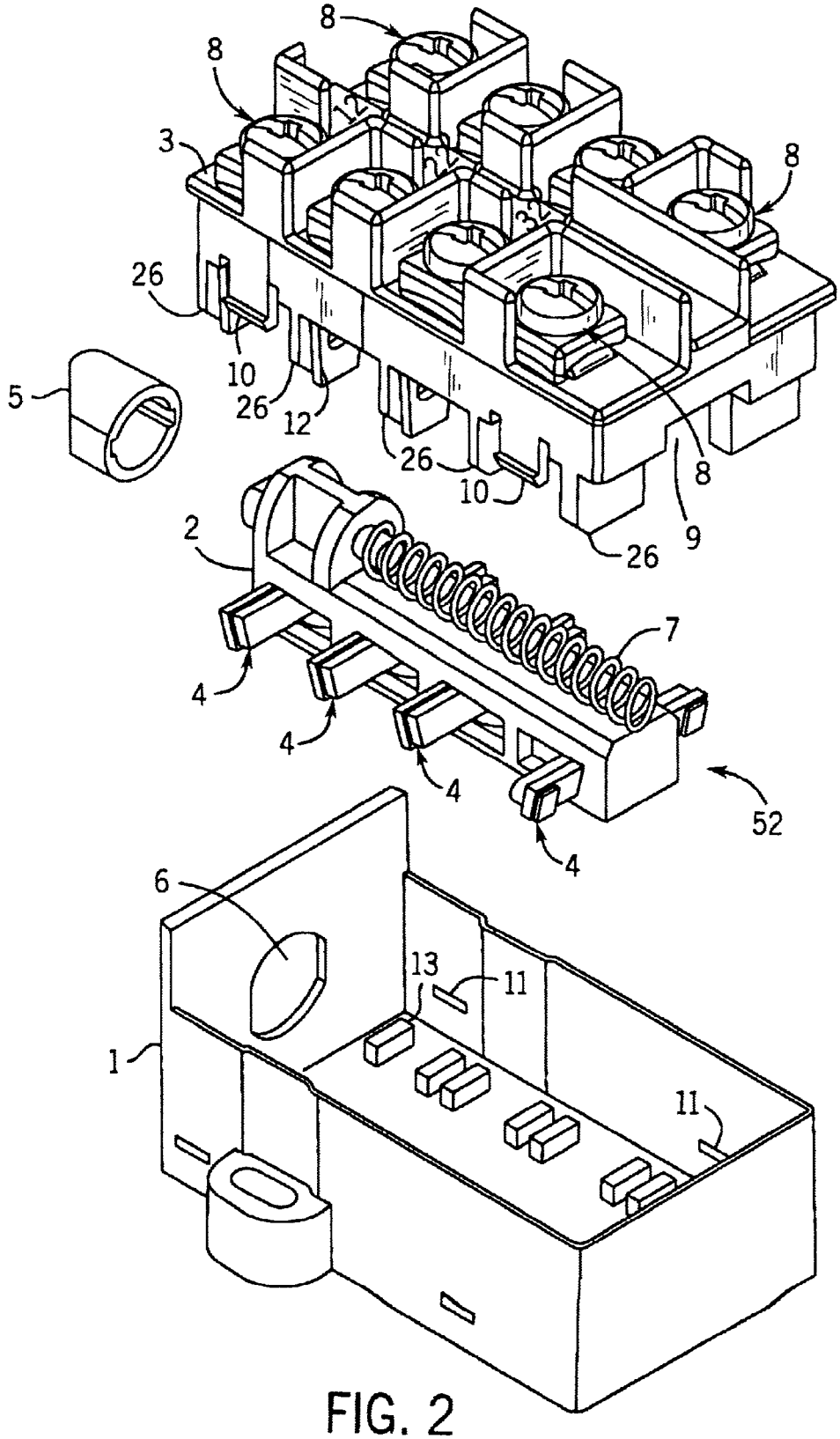
FIG. 2 is an exploded view of components making up the contact assembly of FIG. 1.

Referring to FIGS. 1 and 2, the illustrated contact assembly comprises a casing, an actuator or actuator assembly 52 incorporating a carrier 2, a fixed contact assembly including an insulating body 3. The actuator assembly carries four movable contacts 4 and the carrier 2 engages a nose 5 which projects through an aperture 6 in the casing 1. A compression spring 7 biases the carrier 2 so as to push the nose 5 outwards relative to the aperture 6. The insulating body 3 supports four pairs of fixed contacts 8.

The components shown in FIG. 2 are assembled by dropping the actuator assembly including carrier 2 into the casing 1 such that the nose 5 projects through the opening 6 and then dropping the insulating body 3 over the actuator assembly. The underside of the insulating body 3 defines a recess 9 which accommodates the actuator assembly. Resilient hooks 10 defined by the insulating body 3 engage in apertures 11 defined in the casing 1 so as to retain the assembled components in position. Each of the fixed contacts defines a leg 12 which extends through an aperture in the insulating body 3 and is received in a slot 13 defined in the base of the casing 1. Each of the fixed contacts is thus securely held in position as a result of its engagement in an aperture defined in the insulating body 3 and one of the slots 13 in the casing 1.

Figure 3:
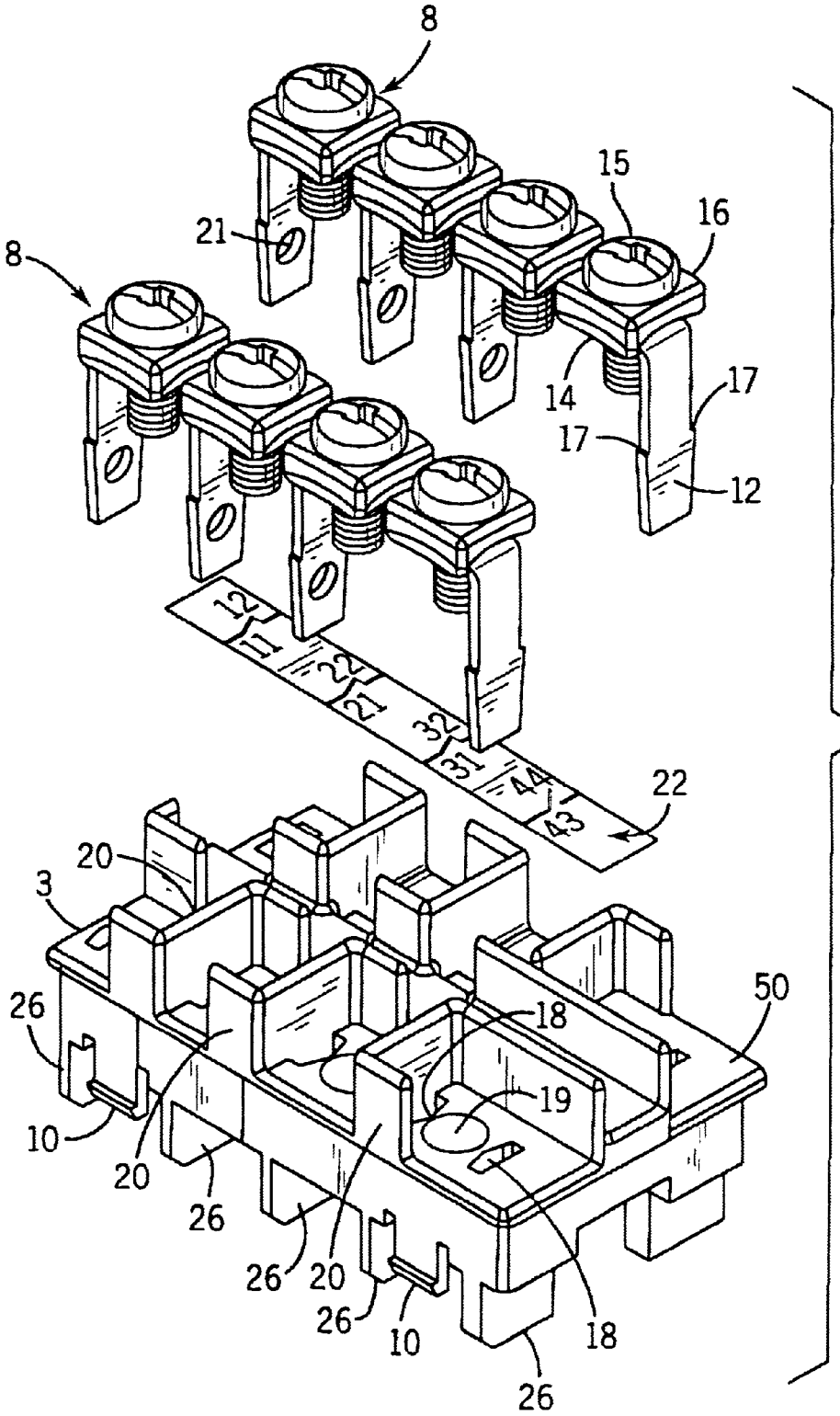
FIG. 3 is an exploded view of one of the components shown in FIG. 2.

The fixed contact assembly is illustrated in further detail in FIG. 3. It will be seen that each of the fixed contacts includes two limbs 14 and 12 that define an L-shape including a head portion 14 extending at 90° from the leg 12, a wire gripping screw 15 which is threaded and received in a threaded aperture in the head of the fixed contact, and a wire gripping washer 16 which is carried on the screw 15. Thus when it is desired to make a connection to one of the fixed terminals, the screw 15 is loosened, the wire is inserted between the head 14 and the washer 16, and the screw is tightened down. Each leg 12 defines a pair of projections 17 for retaining the leg in engagement with the body 3 by engaging the edges of apertures 18 through which the legs are inserted.

The insulating body 3 defines a partition 50 through which the apertures 18 are defined to receive the legs 12 of the fixed contacts, and further apertures 19 are defined to receive the threaded ends of the screws 15. Adjacent fixed contacts are separated by insulating walls 20 so that eight mutually isolated regions are formed on one side of the partition through which the apertures 18 extend, each of these regions receiving a single fixed contact had. In the illustrated case apertures 18 are provided to allow the insertion of fixed contacts in one of two positions but it will be appreciated that only a single aperture 18 may be provided in each of the regions so as to predetermine the orientation in which any one fixed contact is inserted.

Each of the legs 12 has on the side of the leg from which the associated head 14 extends a silver contact area 21 against which the movable contacts carried by the actuator will bear. In addition a label 22 is received in an elongate recess provided between the two rows of four fixed contacts 8, the label carrying a graphical representation of the normal state of the switches defined by the pairs of fixed contacts 8 and the associated movable contacts 4. Thus it will be seen that in the illustrated case three of the switches are normally closed and one is normally open. Displacement of the actuator will reverse this condition such that the three previously closed switches will open and the single previously opened switch will close. This functional interrelationship is the result of the positioning of the movable contacts 4 on the actuator carrier 2 and the positioning of the fixed contacts 8 on the insulating body 3.

Figure 4:
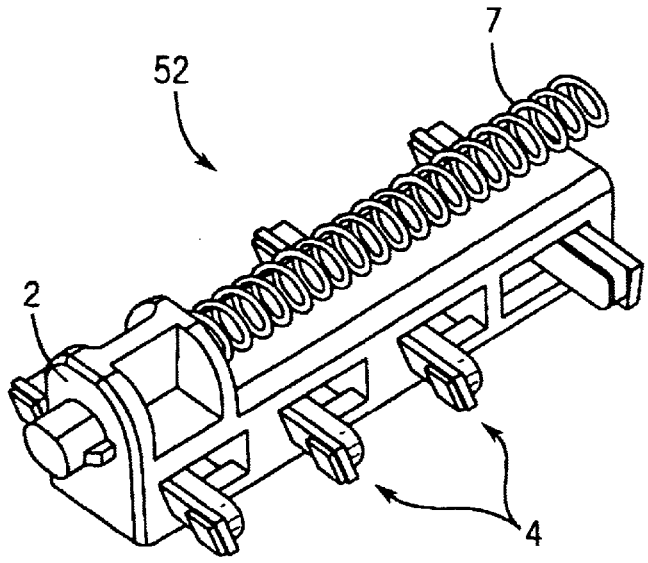
FIG. 4 is a view from a different direction of one of the components shown in FIG. 2.
Figure 5:
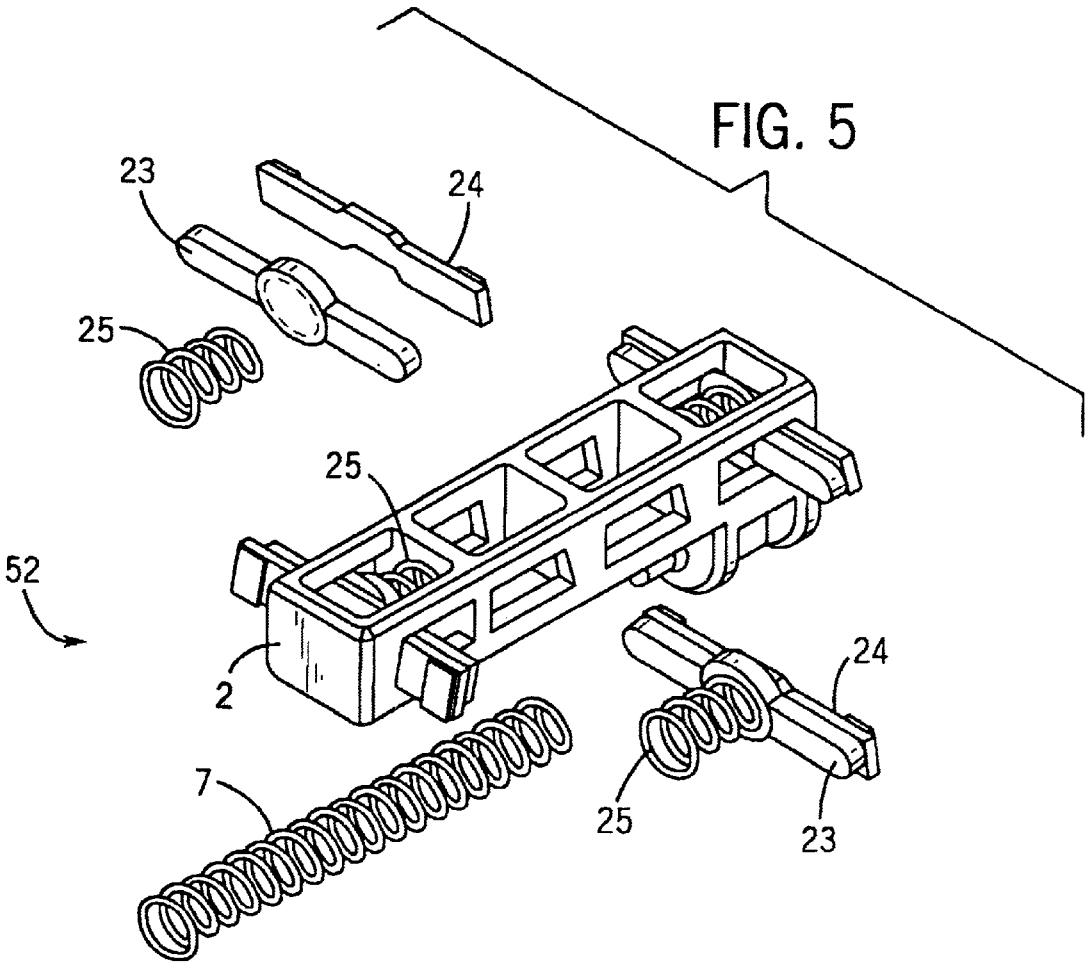
FIG. 5 is an exploded view of the components shown in FIG. 4.

FIGS. 4 and 5 illustrate the actuator assembly in greater detail. Each movable contact 4 comprises an electrically insulating support plate 23 supporting an electrically conducting contact plate 24, the support plate 23 being biased by a compression spring 25 to a rest position in which as best shown in FIG. 4 the contact plate is rotated slightly so as to assume a position inclined to a plane perpendicular to the direction of displacement of the actuator carrier 2. This provides the contacts with a "rolling" motion as they are pushed back against the spring 25 as a result of being brought into contact with the legs of the fixed contacts 8.

With the illustrated arrangement, each of the legs 12 of the fixed contacts extends through an aperture 18 in the partition defined by the insulating body 3 into a region within which one of the movable contacts 4 is received. That region is defined between two partition walls 26 adjacent to one of which walls the leg 12 is positioned. Thus the available space for displacement of the movable contacts is the spacing between the walls 26 less the thickness of the leg 12. The absence of a second fixed contact leg extending into this space makes it possible to reduce the spacing between adjacent fixed contacts as the movable contacts are displaceable the full distance from the side of the leg from which the fixed contact head 14 extends to the nearest adjacent partition wall 26.

I claim:

1. A contact assembly comprising:

an electrical insulating body including a partition having first and second sides, a plurality of separate regions formed on the first side of the partition, the partition forming two apertures that extend from the first side to the second side in each of at least two of the regions and forming at least one aperture in each of the other regions that extends form the first side to the second side;

a plurality of pairs of spaced-apart fixed wherein each fixed contact has two limbs defining an L-shape, one limb defining a single leg and the other limb extending to one side of the leg to define a head supporting a terminal for gripping a wire, each fixed contact corresponding to a separate one of the regions, each leg extending through one of the apertures in the corresponding region, the contacts corresponding to the at least two regions that include two apertures positionable with their legs extending through either of the apertures in a corresponding region;

an actuator displaceable relative to the body between first and second positions;

a plurality of movable contacts mounted on the actuator, each movable contact being positioned on the actuator so as to interconnect the contacts of a respective pair of fixed contacts only when the actuator is in one of the first and second position; and wherein, each movable contact is displaceable into contact with the leg of each of the respective pairs of fixed contacts on the side of the leg from which the head extends and on the side of the partition remote from the head irrespective of the orientation of the contacts corresponding to the at least two regions that include two apertures in a corresponding region.

2. A contact assembly according to claim 1, wherein the partition forms two apertures in each of the regions and each of the fixed contact legs is positionable to extend through either of the apertures in the corresponding region.

3. A contact assembly according to claim 2, wherein the terminal for gripping a wire comprises a screw received in a threaded aperture in the head of the fixed contact.

4. A contact assembly according to claim 2, wherein the insulating body is a snap fit within a casing, the insulating body defining a recess, and the actuator being received within the recess between the insulating body and the casing.

5. A contact assembly according to claim 2, wherein the actuator comprises a carrier displaceable relative to the insulating body, the movable contacts being supported by and displaceable relative to the carrier.

6. A contact assembly according to claim 5, wherein each movable contact is spring biased relative to the carrier to a rest position in which it bears against the carrier and from which it is displaced to a working position when bearing against the fixed contacts.

7. A contact assembly according to claim 5, wherein each movable contact is in a working position when the contact makes contact with the legs of a fixed contact and is in a rest position otherwise, each movable contact, when in the rest position, inclined with respect to its orientation when in the working position.

8. A contact assembly according to claim 2, wherein the insulating body caries an elongated label extending adjacent the pairs of fixed contacts and indicating the normal condition of the switches defined by the associated movable contacts and fixed pairs of contacts.

9. A contact assembly according to claim 1, wherein the actuator comprises a carrier displaceable relative to the insulating body, the movable contacts being supported by and displaceable relative to the carrier.

10. A contact assembly according to claim 9, wherein each movable contact is in a working position when the contact makes contact with the legs of a fixed contact and is in a rest position otherwise, each movable contact, when in the rest position, inclined with respect to its orientation when in the working position.

11. A contact assembly according to claim 1, wherein the leg of each fixed contact defines at least one projection which engages behind an edge of the aperture in the partition to retain the fixed contact in position after insertion of the leg through the partition aperture.

12. A contact assembly according to claim 1, wherein each fixed contact is formed from a single strip of metal shaped such that the leg extends at substantially 90° to the head.

13. A contact assembly according to claim 1, wherein the terminal for gripping a wire comprises a screw received in a threaded aperture in the head of the fixed contact.

14. A contact assembly according to claim 1, wherein the insulating body is a snap fit within a casing, the insulating body defining a recess, and the actuator being received within the recess between the insulating body and the casing.

15. A contact assembly according to claim 1, wherein each movable contact is spring biased relative to the carrier to a rest position in which it bears against the carrier and from which it is displaced to a working position when bearing against the fixed contacts.

16. A contact assembly according to claim 1, wherein the insulating body caries an elongated label extending adjacent the pairs of fixed contacts and indicating the normal condition of the switches defined by the associated movable contacts and fixed pairs of contacts.

17. A contact assembly according to claim 1 wherein each fixed contact further includes a contact area on a side of the fixed contact leg that faces in the same direction as the fixed contact head member.

18. A contact assembly comprising:

an electrical insulating body including a partition having first and second sides, a plurality of separate regions formed on the first side of the partition, the partition forming two apertures that extend from the first side to the second side in each of the regions;

a plurality of pairs of spaced-apart fixed contacts wherein each fixed contact has two limbs defining an L-shape, one limb defining a single leg and the other limb extending to one side of the leg to define a head supporting a terminal for gripping a wire, each fixed contact corresponding to a separate one of the regions, each leg extending through one of the apertures in the corresponding region and positionable to extend through either of the apertures in a corresponding region;

an actuator displaceable relative to the body between first and second positions;

a plurality of movable contacts mounted on the actuator, each movable contact being positioned on the actuator so as to interconnect the contacts of a respective pair of fixed contacts only when the actuator is in one of the first and second position; and wherein, each movable contact is displaceable into contact with the leg of each of the respective pairs of fixed contacts on the side of the leg from which the head extends and on the side of the partition remote from the head irrespective of which of the apertures in each region through which corresponding legs extend.

* * * * *